US008303332B2

(12) United States Patent
Wertz

(10) Patent No.: US 8,303,332 B2
(45) Date of Patent: Nov. 6, 2012

(54) SOCKET CONNECTOR ASSEMBLY WITH FLEXIBLE ORIENTATION HEAT PIPE

(75) Inventor: Darrell Lynn Wertz, Chandler, AZ (US)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 126 days.

(21) Appl. No.: 13/007,500

(22) Filed: Jan. 14, 2011

(65) Prior Publication Data

US 2012/0184129 A1 Jul. 19, 2012

(51) Int. Cl.
*H01R 13/00* (2006.01)

(52) U.S. Cl. ..... 439/485

(58) Field of Classification Search ..... 439/485, 439/487, 73, 331; 361/719, 685, 687, 699, 361/700, 717, 718, 819, 720; 165/104.33; 257/718, 719

See application file for complete search history.

(56) References Cited

U.S. PATENT DOCUMENTS

| | | | | |
|---|---|---|---|---|
| 7,008,239 | B1 | 3/2006 | Ju | |
| 7,589,972 | B2 | 9/2009 | Ma et al. | |
| 7,619,895 | B1 | 11/2009 | Wertz et al. | |
| 7,641,505 | B2 * | 1/2010 | Ma | 439/485 |
| 7,883,357 | B2 * | 2/2011 | Lin et al. | 439/487 |
| 8,021,179 | B1 * | 9/2011 | Wertz | 439/331 |

* cited by examiner

*Primary Examiner* — Edwin A. Leon

(74) *Attorney, Agent, or Firm* — Wei Te Chung; Ming Chieh Chang

(57) ABSTRACT

A socket connector assembly, adapted for electrically connecting an IC package and a printed circuit board, comprises an insulative housing, a cover plate, a heat pipe retainer with two heat pipes, and a plurality of fastening members. The insulative housing defines a space for the IC package. The heat pipe retainer with the heat pipes are seated on the IC package received in the insulative housing. The cover plate is upon the heat pipe retainer. The heat pipe retainer is formed with a dowel pin in a center thereof, and the cover plate is formed with a hole receiving the dowel pin, so that the heat pipe retainer is flexibly orientated and can rotates around the hole. The cover plate defines at least one first pressing finger downward pressing an upper surface of the heat pipe retainer so as to exert downward force evenly to a heat pipe retainer therefore preventing potential warpage of the heat pipe.

20 Claims, 7 Drawing Sheets

SOCKET CONNECTOR ASSEMBLY WITH FLEXIBLE ORIENTATION HEAT PIPE

BACKGROUND OF THE INVENTION

1. Field of the Invention

The present invention relates to a socket connector assembly which is used for connecting an electronic package, such as a central processing unit (CPU), with a circuit substrate, such as a printed circuit board (PCB).

2. Description of the Prior Art

U.S. Pat. No. 7,008,239, issued on Mar. 7, 2006, discloses a socket connector mounted on a printed circuit board (PCB). The socket includes an insulative housing, a plurality of contacts, four screw nuts and four screws, a lid and a heat guide pipe. The insulative housing has a plurality of slots for receiving the contacts and a border projecting therefrom and around the slots for orientating an electronic component, such as an IC module. The screw nuts connect the insulative housing to the PCB from a bottom side of the PCB. The screws engage with the screw nuts from a top side of the PCB. The lid is arranged between the screws and the insulative housing. A head of each screw presses the lid to urge the top surface of the IC module for positioning the IC module in the insulative housing. The heat guide pipe is assembled on a top surface of the lid and connects with a heat dissipation device for further heat dissipation. However, since the lid which is assembled with the heat guide pipe is firmly retained to the insulative housing, an extending direction of the heat guide pipe is determinate once the lid is assembled to the insulative housing. So a field on the printed circuit board for a heat dissipation which connects the heat pipe is limited. Moreover, the IC package may be damaged because the lid is directly and rigidly pressed on the IC package.

Accordingly, a new socket connector assembly that solves the above problems is desirable.

SUMMARY OF THE INVENTION

Accordingly, an object of the present invention is to provide a socket connector assembly which has flexibly orientated heat pipes.

Accordingly, another object of the present invention is to provide a socket connector assembly provided with flexible means asserting downward force evenly to a heat pipe retainer and a protective plate therefore preventing potential warpage of the heat pipe and the IC package.

To fulfill the above object, a socket connector assembly, adapted for electrically connecting an IC package and a printed circuit board, comprises an insulative housing, a cover plate, a heat pipe retainer embedded with two heat pipes, and a plurality of fastening members. The insulative housing defines a space for the IC package. The heat pipe retainer with the heat pipes are seated on the IC package that received in the insulative housing. The cover plate is upon the heat pipe retainer. The heat pipe retainer is formed with a dowel pin in a center thereof, and the cover plate is formed with a hole receiving the dowel pin, so that the heat pipe retainer is flexibly orientated and can rotates around the hole. The cover plate defines at least one first pressing finger downward pressing an upper surface of the heat pipe retainer so as to exert downward force evenly to a heat pipe retainer therefore preventing potential warpage of the heat pipe.

Other objects, advantages and novel features of the present invention will become more apparent from the following detailed description when taken in conjunction with the accompanying drawings, in which:

DESCRIPTION OF PREFERRED EMBODIMENTS OF THE INVENTION

Reference is now made to the drawings to describe the invention in detail.

Referring to FIGS. 1-7, a socket connector assembly 3 in accordance with a preferred embodiment of the present invention is shown, which is adapted for electrically connecting an IC package 1 and a printed circuit board 2.

Figure 1:
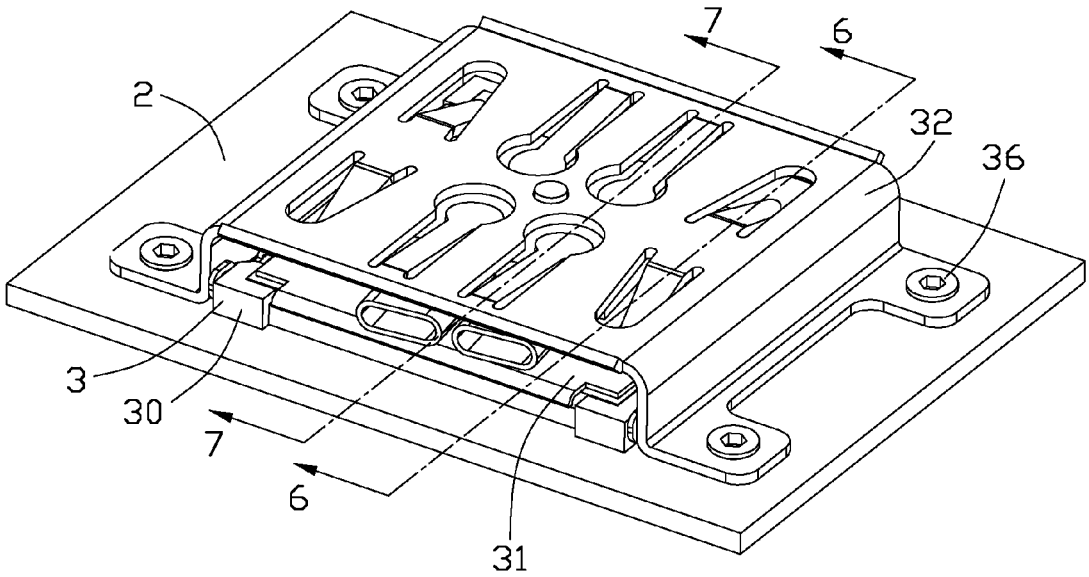
FIG. 1 is an assembled, perspective view of a socket connector assembly receiving an IC package and mounted on a printed circuit board, in accordance with the present invention.
Figure 2:
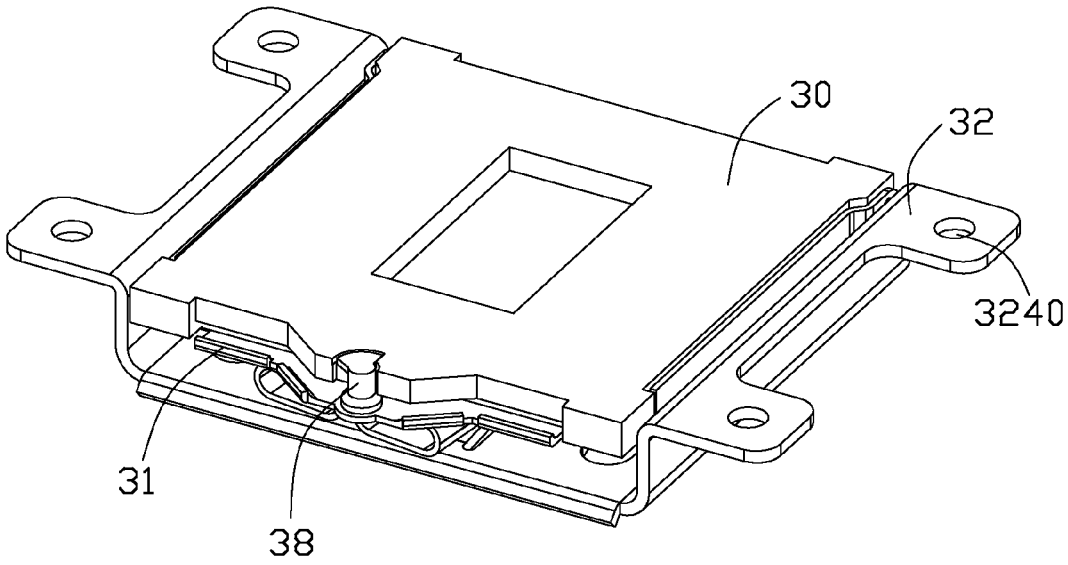
FIG. 2 is similar to FIG. 1, taken from a bottom side, wherein the printed circuit board is removed from the socket connector assembly.
Figure 3:
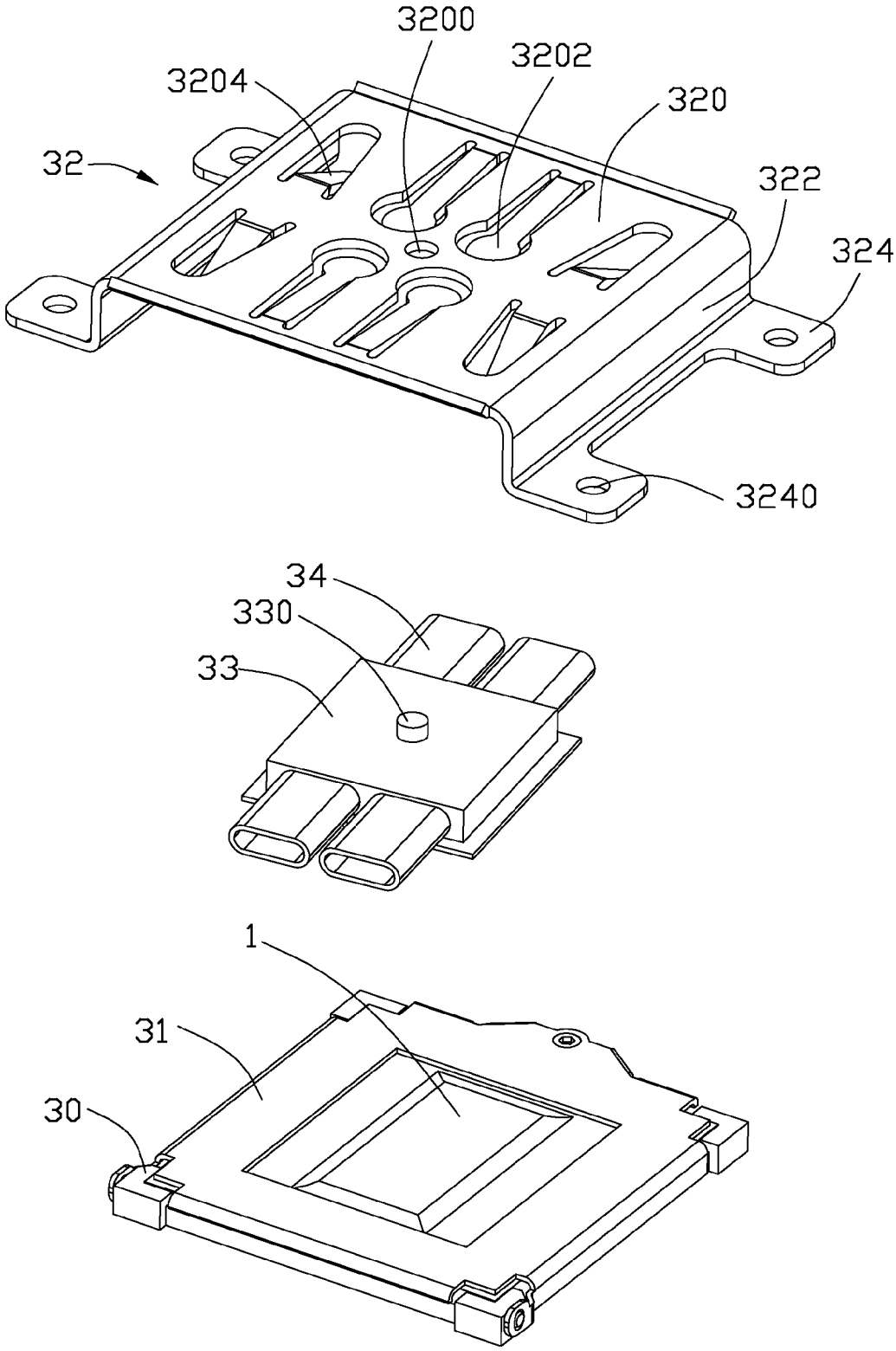
FIG. 3 is a partially assembled, perspective view of the socket connector assembly in FIG. 1, wherein a heat pipe retainer and cover plate are removed from the socket connector assembly.
Figure 4:
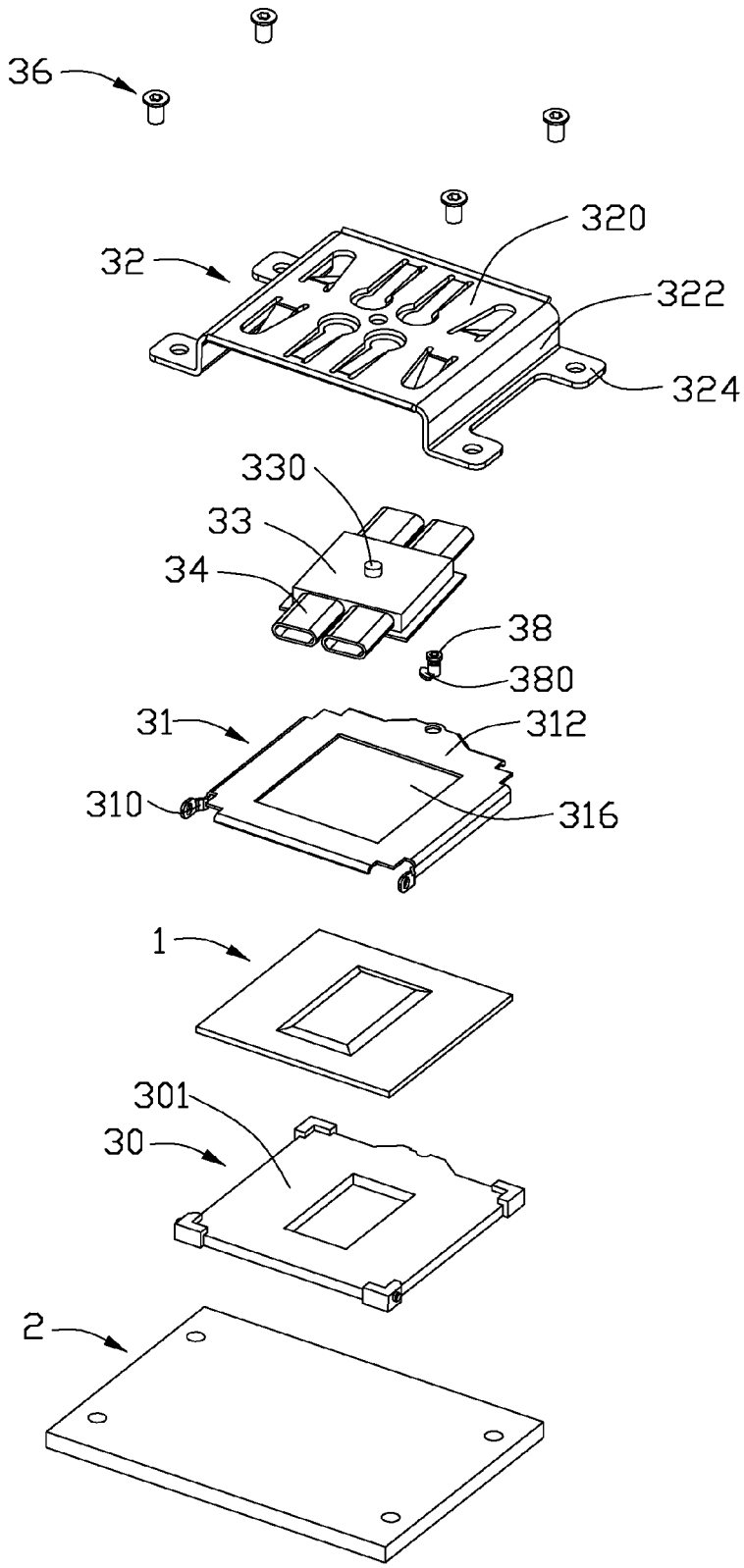
FIG. 4 is an exploded, perspective view of the socket connector assembly in FIG. 1.
Figure 5:
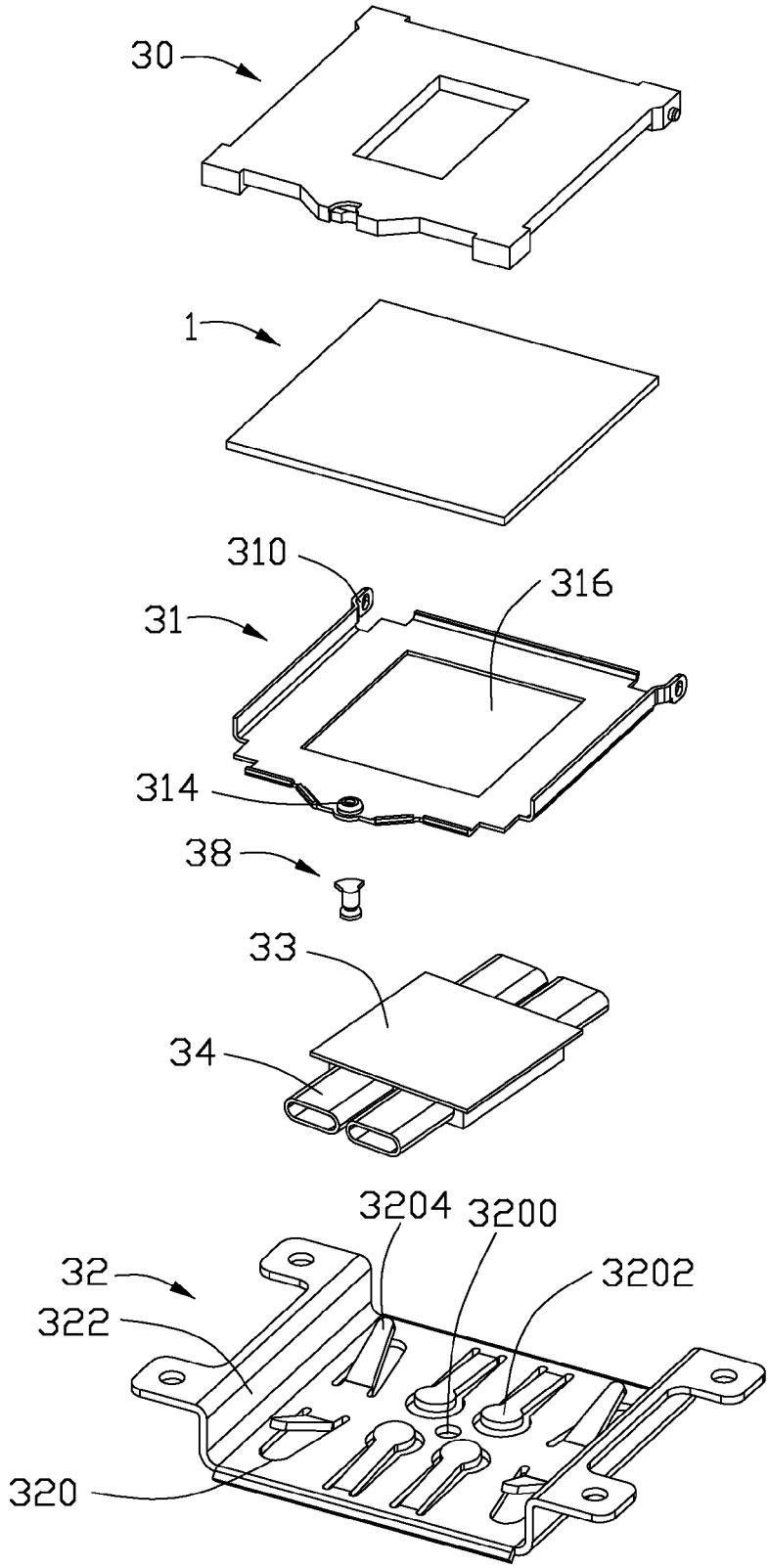
FIG. 5 is similar to FIG. 4, taken from a bottom side.
Figure 6:
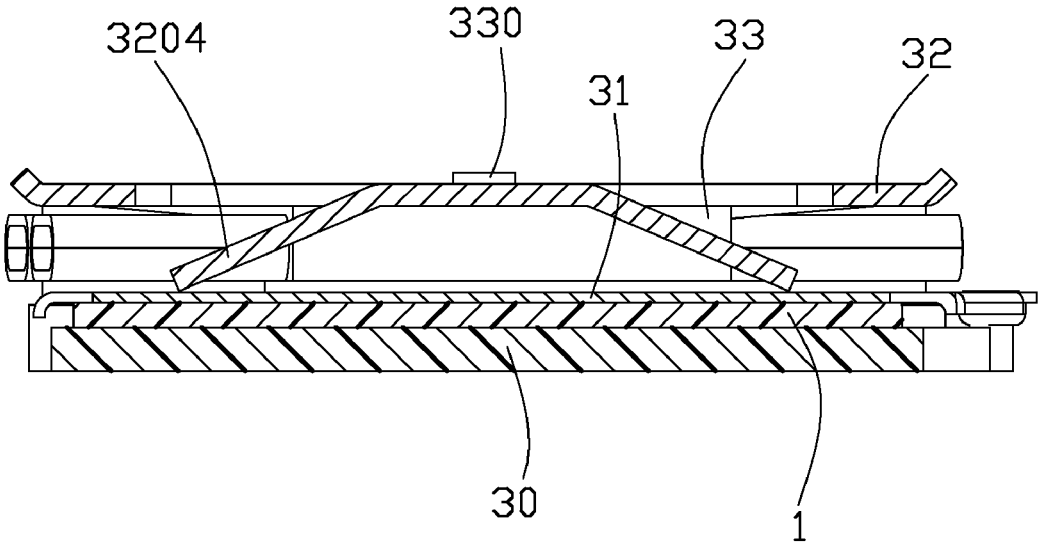
FIG. 6 is a cross-sectional view taken along line 6-6 in FIG. 1.
Figure 7:
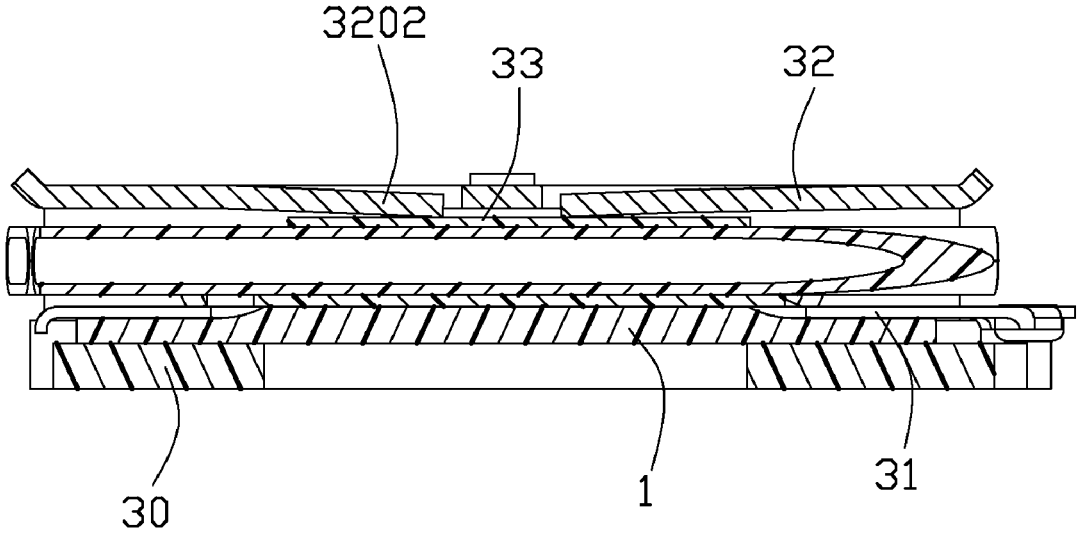
FIG. 7 is a cross-sectional view taken along line 7-7 in FIG. 1.

The socket connector assembly 3 comprises an insulative housing 30, a protective plate 31, a cover plate 32, a heat pipe retainer 33 embedded with two heat pipes 34, and a plurality of fastening members 36. One end of the protective plate 31 has two connecting portion 310 at opposite edges, which are pivotally mounted on opposite sidewalls of the insulative housing 30 thereby allowing the protective plate 31 rotating between a closed position and an opening position relative to the housing 30. An opposite end of the protective plate 31 defines an extending portion 312 with an opening 3120 thereon. The protective plate 31 further defines a screw member 314 arranged on a lower surface of the extending portion 312 and communicated with the opening 3120. Referring to FIG. 2, when the protective plate 31 is at the closed position, a latch member 38 is used to interconnect with the screw member 314. The latch member 38 is formed with screw on one end thereof and a blade 380 on the other end for grasping a portion of the housing 30, thereby preventing rotation of the protective plate 31 when it is at the closed position. The heat pipe retainer 33 with the heat pipes 34 are seated on the IC package 1 received in the insulative housing 30. The cover plate 32 is covered on the heat pipe retainer 33.

The insulative housing 30 defines a space 301 for receiving the IC package 1 and receives a plurality of terminals (not shown). The protective plate 31 is stamped from a metal piece and in mounted on the housing 30. The protective plate 31 has an opening 316 corresponding to the space 301 of the housing, so as to allow the heat pipe 34 to be contacted with the IC package 1.

The cover plate 32 is located upon the heat pipe retainer 33 and covers the insulating housing 30. The cover plate 32 is piece-like and comprises an elongate plate 320 and a pair of wings 322 extending downwardly from opposite edges of the elongate plate 320, and the wings 322 each defines a pair of mounting pads 324 bending from opposite ends thereof and extending along a horizontal direction. The mounting pads 324 each have a through hole 3240 thereon allowing the fastening members 34 passing through. The elongate plate 320 is formed with a hole 3200 in a center of thereof. The elongate plate 320 also defines a first set of pressing fingers 3202 and a second set of pressing fingers 3204 downwardly.

The heat pipe retainer 33 has two heat pipes 34 assembled therein. A dowel pin 330 is formed in a center of the heat pipe retainer 33.

In an assembly process, the IC package 1 is received in the space 301 of the housing 30 and the heat pipe retainer 33 is located upon the IC package 1 and contacting with the IC package 1. The cover plate 32 covers the heat pipe retainer 33 under condition that the first set of pressing fingers 3202 downward pressing on the heat pipe retainer 33 and a second set of pressing fingers 3204 downward pressing on the protective plate 31. The heat pipe retainer 33 is pivotally assembled to the cover plate 32 by the hole 3200 rotatably receiving the dowel pin 332, so the heat pipe retainer 33 with the heat pipes 34 is flexibly orientated and can rotate around the dowel pin 332. The fastening members 36 fasten the cover plate 32 and the printed circuit board 2 together. Accordingly, a steady electrical connection system is established between the printed circuit board 2 and the IC package 1 by the socket connector assembly 3.

Since the first set, and second set of pressing fingers 3202, 3204 are formed on the cover plate 32, loading mechanism of the socket connector assembly 3 has a simple structure. Moreover, the pressing fingers are formed with flexible function exerting downward force evenly to the heat pipe retainer 33 and the protective plate 31 therefore preventing potential warpage of the heat pipe 34 and the IC package 1.

Furthermore, although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. A socket connector assembly for electrically connecting an IC package and a printed circuit board, comprising:

an insulative housing defining a space for the IC package;

a heat pipe retainer assembled with at least one heat pipe; and a cover plate located upon the heat pipe retainer and substantially covering the heat pipe retainer and the at least one heat pipe;

wherein one of the cover plate and the heat pipe retainer has a dowel pin, and the other defines a hole rotatably receiving the dowel pin to flexibly orientate the heat pipe retainer with the heat pipe; and wherein the cover plate defines at least one first pressing finger downward pressing an upper surface of the heat pipe retainer.

2. The socket connector assembly of claim 1, wherein the dowel pin is formed in a center of the heat pipe retainer, and the hole is formed in a center of the cover plate, the heat pipe retainer can rotates around the hole at a certain region of angle.

3. The socket connector assembly of claim 2, further comprising a protective plate having connecting portion pivotally connected with the insulative housing at one end thereof for positioning the IC package in the housing and defining an opening corresponding to the space of the insulative housing.

4. The socket connector assembly of claim 3, wherein the cover plate defines at least one second pressing finger downward pressing an upper surface of the protective plate.

5. The socket connector assembly of claim 4, wherein the cover plate comprise an elongate plate and a pair of wings extending downwardly from opposite edges of the elongate plate, and the wings each defines a pair of mounting pads bending from opposite ends thereof and extending along a horizontal direction.

6. The socket connector assembly of claim 5, wherein the mounting pads each defines a through hole extending therethrough.

7. The socket connector assembly of claim 3, wherein the cover plate comprises an extending portion at an opposite end, and the extending portion defining a through hole thereon.

8. The socket connector assembly of claim 7, wherein the extending portion defines a screw member arranged on a lower surface thereof and communicated with the through hole of the extending portion.

9. The socket connector assembly of claim 8, wherein further comprises a latch member having screw on one end thereof for interconnecting with the screw member of the cover plate and a blade on the other end thereof for grasping the housing, thereby positioning the cover plate at a closed positioned.

10. A socket connector assembly for electrically connecting an IC package and a printed circuit board, comprising:

an insulative housing defining a space for receiving the IC package;

a protective plate mounted on the insulative housing and defining an opening corresponding to the space;

a cover plate being upon the insulative housing and the protective plate for positioning the IC package in the space of the housing;

a heat pipe retainer with at least one heat pipe assembled thereto being located upon the protective plate and covered by the cover plate; and wherein the cover plate defines a first set of pressing fingers downward for pressing the heat pipe retainer and a second set of pressing fingers downward for pressing the protective plate.

11. The socket connector assembly of claim 10, wherein the heat pipe retainer is pivotally connected with the cover plate.

12. The socket connector assembly of claim 11, wherein the heat pipe retainer is formed with a dowel pin in a center thereof, and the cover plate is formed with a hole in a center thereof, the dowel pin is received in the hole, so that the heat pipe retainer can rotates around the hole.

13. The socket connector assembly of claim 10, wherein the cover plate comprise an elongate plate and a pair of wings extending downwardly from opposite edges of the elongate plate, and the first and second pressing fingers are formed on the elongated plate.

14. The socket connector assembly of claim 13, wherein the wings each defines a pair of mounting pads bending from opposite ends thereof and extending along a horizontal direction.

15. A socket connector assembly for use with a printed circuit board, comprising:

an electrical connector adapted to be mounted to the printed circuit board;

an electronic package mounted upon the connector;

a protective plate seated upon the electronic package to assure reliable connection between the connector and the electronic package;

a central opening formed in the protective plate;

a heat pipe retainer equipped with at least one heat pipe horizontally extending therethrough, and defining a bottom plate intimately contacting the electronic package in an area around the central opening; and a cover plate located above the heat pipe retainer and the protective plate, and defining mounting pads adapted to be secured to the printed circuit board; wherein the cover plate defines a plurality of pressing fingers downwardly pressing the heat pipe retainer; wherein said cover plate is discrete from but associated with the heat pipe retainer in an incomplete fixation manner under condition that the cover plate is equipped restriction structures which allow the heat pipe retainer to move relative to the cover plate horizontally in a limited range.

16. The socket connector assembly as claimed in claim 15, wherein said heat pipe retainer is pivotal relative to the cover plate in said limited range.

17. The socket connector assembly as claimed in claim 16, an pivot axis of said the heat pipe retainer extends vertically through a center of the electronic package.

18. The socket connector assembly as claimed in claim 15, wherein said cover plate is further equipped with other downwardly extending fingers on which said restriction structures are formed.

19. The socket connector assembly as claimed in claim 18, wherein said other downwardly extending figures downwardly press the protective plate.

20. The socket connector assembly as claimed in claim 19, wherein said protective plate is equipped with a securing device adapted to be secured to the printed circuit board.

* * * * *